US006321788B1

(12) United States Patent
Egli

(10) Patent No.: US 6,321,788 B1
(45) Date of Patent: Nov. 27, 2001

(54) PIVOTED PROJECTION HAVING MIXER VALVE

(75) Inventor: Werner Egli, Hüntwangen (CH)

(73) Assignee: Armaturefabrik Wallisellen AG, Wallisellen (CH)

( * ) Notice: Subject to any disclaimer, the term of this patent is extended or adjusted under 35 U.S.C. 154(b) by 0 days.

(21) Appl. No.: 09/432,795

(22) Filed: Nov. 3, 1999

(30) Foreign Application Priority Data

Nov. 4, 1998 (DE) ..... 198 50 839

(51) Int. Cl.[7] ..... E03C 1/04
(52) U.S. Cl. ..... 137/615; 4/677; 137/801
(58) Field of Search ..... 4/677; 137/615, 137/801

(56) References Cited

U.S. PATENT DOCUMENTS 3,373,770 * 3/1968 Ward et al. ..... 137/615
3,410,487 11/1968 Hyde .
3,653,407 * 4/1972 Katva ..... 137/615
3,726,318 4/1973 Hyde .
4,262,699 * 4/1981 Fabian ..... 137/615
4,794,952 1/1989 Burkard .

FOREIGN PATENT DOCUMENTS 31 20210 12/1982 (DE) .
35 19 763 * 12/1986 (DE) .
3811521 10/1989 (DE) .

* cited by examiner

*Primary Examiner*—Gerald A. Michalsky
(74) *Attorney, Agent, or Firm*—Sughrue, Mion, Zinn, Macpeak & Seas, PLLC

(57) ABSTRACT

The armature consists of a base part (12), in which a pivoting outlet (2) is mounted in a pivoting manner, in which a mixer valve (1) with one connection (9) each for cold and warm water is mounted. A rotating part (8) is inserted into the base part (12) with one first canal (18, 19) each for cold and warm water. The first canals (18, 19) are connected via rigid lines (7) with the connections (9). The supply lines (16', 17') for cold and warm water are connected to second canals (16, 17) in the base part (12). The first and second canals (16–19) are connected hydraulically via a separate pivoting connection each. In so doing, an unimpaired pivoting of the outlet as well as a problem-free implementation of the high-pressure warm and cold water supply to the mixer valve is made possible.

17 Claims, 5 Drawing Sheets

PIVOTED PROJECTION HAVING MIXER VALVE

Mixers have become known which use, as a water supply for cold and warm water, flexible hoses that extend from the base, which is tightly connected to the working surface, to the mixer mounted at end of the outlet. Since these hoses are constantly exposed to the pressure of the water supply line, they have to be surrounded by a metal lattice. With these hoses, the ability of the outlet to pivot within a limited range is made possible. With every pivoting of the outlet, however, a torque is applied to the screw connections of the hoses in the tight base part, which leads to that the connections release themselves and thus could become imperfectly sealed. Further, the danger exists that the metal lattice is damaged through the constant twisting and that the hose breaks. In addition, the two relatively rigid hoses can oppose the pivoting movement of the outlet in both of the terminal positions by means of an undesirable resistance, and the hoses, if they touch one another or the inside of the outlet, can cause an ugly scratching sound and also damage to the metal lattice. If a hose connection or a hose leaks, the leaking water runs back through the outlet and drips off below the working surface. Since this leaking water often remains unnoticed for a longer period of time, larger water damage can occur.

In DE-OS 31 20 210, a pivoting outlet having a mixer valve at the free end is described which partially eliminates a part of the above problem. The front end of the hoses for the cold and warm water can be rotated but is inserted in borings of the mixer housing in an axially secured manner. The hoses must then rotate themselves, in the pivoting of the outlet, lengthwise along its curved axle. In so doing, the metal lattices of the hoses can still rub against one another because both hoses have to turn in the same direction. Additionally, the O-ring seal of the pivoting hose ends can become imperfectly sealed over time.

It is the object of the present invention to create a pivoting outlet which makes possible an unhindered pivoting of the outlet and a problem-free throughput of the high-pressure, warm and cold water supply to the mixer valve. This problem is solved by means of the combination of characteristics of claim 1.

In the following, embodiment examples of the invention are explain using the diagrams.

Figures 1, 3:
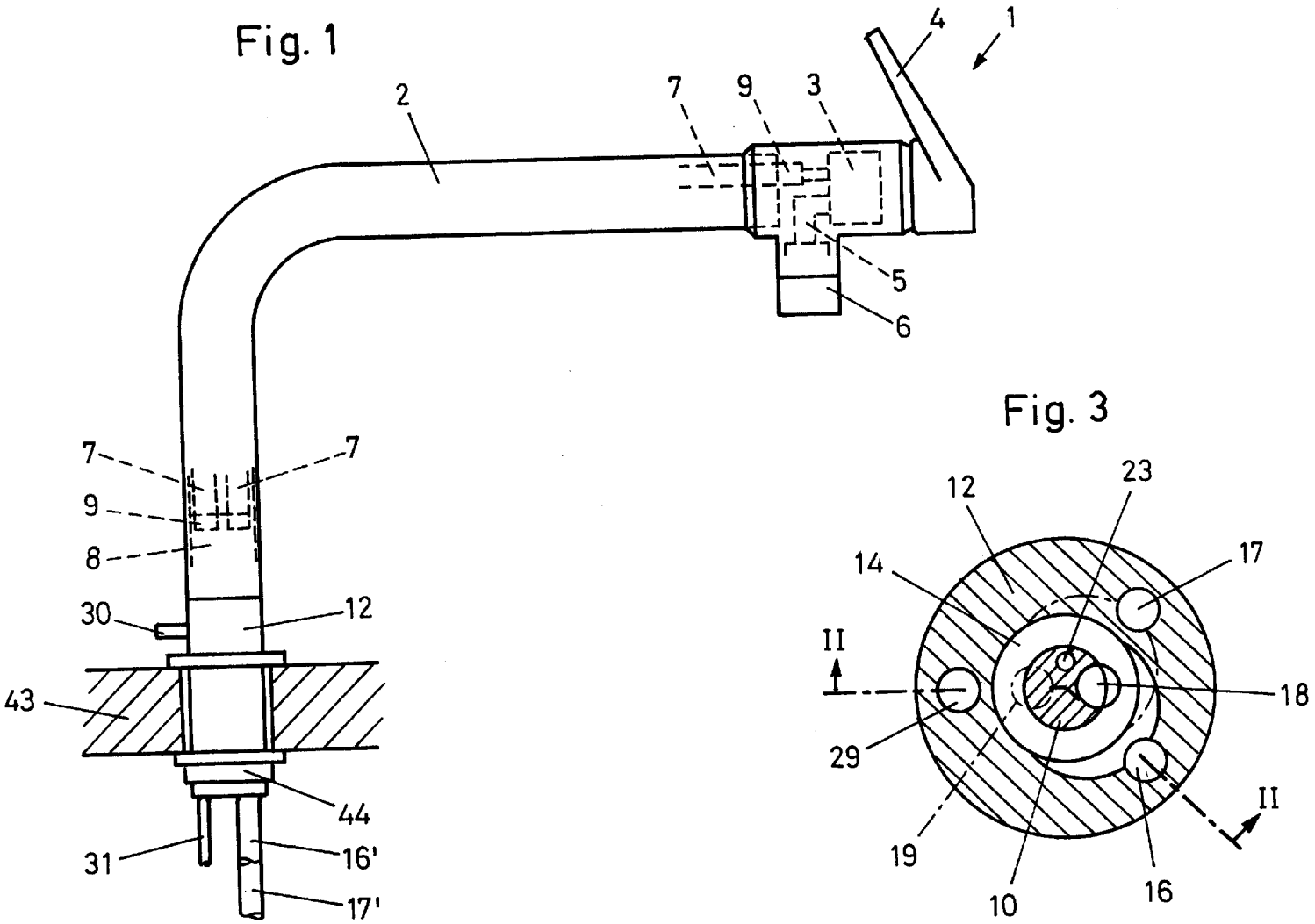
FIG. 1 shows a lateral view of a pivoting outlet with an integrated mixer valve in the front.
FIG. 3 shows a cross-section through the rotating connection along line III—III in FIG. 2.

In FIG. 1, it can be seen that a mixer valve 1 is integrated in the front of a pivoting outlet 2. The mixer valve exhibits a commercially used cartridge 3 and an activation lever 4. By pulling the activation lever, the outlet amount is adjusted and by turning the temperature is adjusted. The mixed water flows through canal 5 to a commercially used outlet nozzle 6. The supply of cold and warm water to the mixer occurs, for example, by means of two copper pipes 7 or flexible hoses which are tightly secured not only in the mixer 1 but also in the rotating part 8 in connection 9, for example, by means of soldering or screwing. The rotating part 8 has a cylindrical part 10 which is inserted into sack-like boring 11 of the base part 12, so as to rotate. The upper part 13 of the rotating part 8 has a diameter which corresponds to the inner diameter of the pivoting outlet 2, and it is tightly connected to it, for example, by means of soldering. The cylindrical part 10 contains two axially shifted circumferential grooves 14, 15 which establish the connection between the cold and warm water inlet 16, 17 and both of the tap lines 18, 19. The seal between both of the grooves 14, 15 occurs by means of the O-ring 20 and the seal outward through both of the O-rings 21. These three O-rings together with the brake O-ring 22 result in certain brake torque which has to be somewhat larger than the torque necessary for the rotating of the activation lever 4. The rotating part 8 has a pervasive axial relief boring 23. This has the purpose of preventing a pumping effect during installation or a build-up of pressure through leaking water at the bottom 24 of the sack-like boring 11. Possibly accumulating water leakage is lead through this boring 23 in the upward direction and can exit via the overflow canal 25 and the boring 26. The axial detention of the rotating part 8 occurs with one or multiple screws 27. For the purpose of limiting the pivoting angle, a pin 28 is inserted in the base part 12 which pin grips into a circumferential groove 32 of the rotating part 8. Also built into the base part 12 is a tie bar 29 with an axially shifting activation handle 30 and a Bowden tension cord 31 for the operating of a (not shown) discharge valve.

Figure 4:
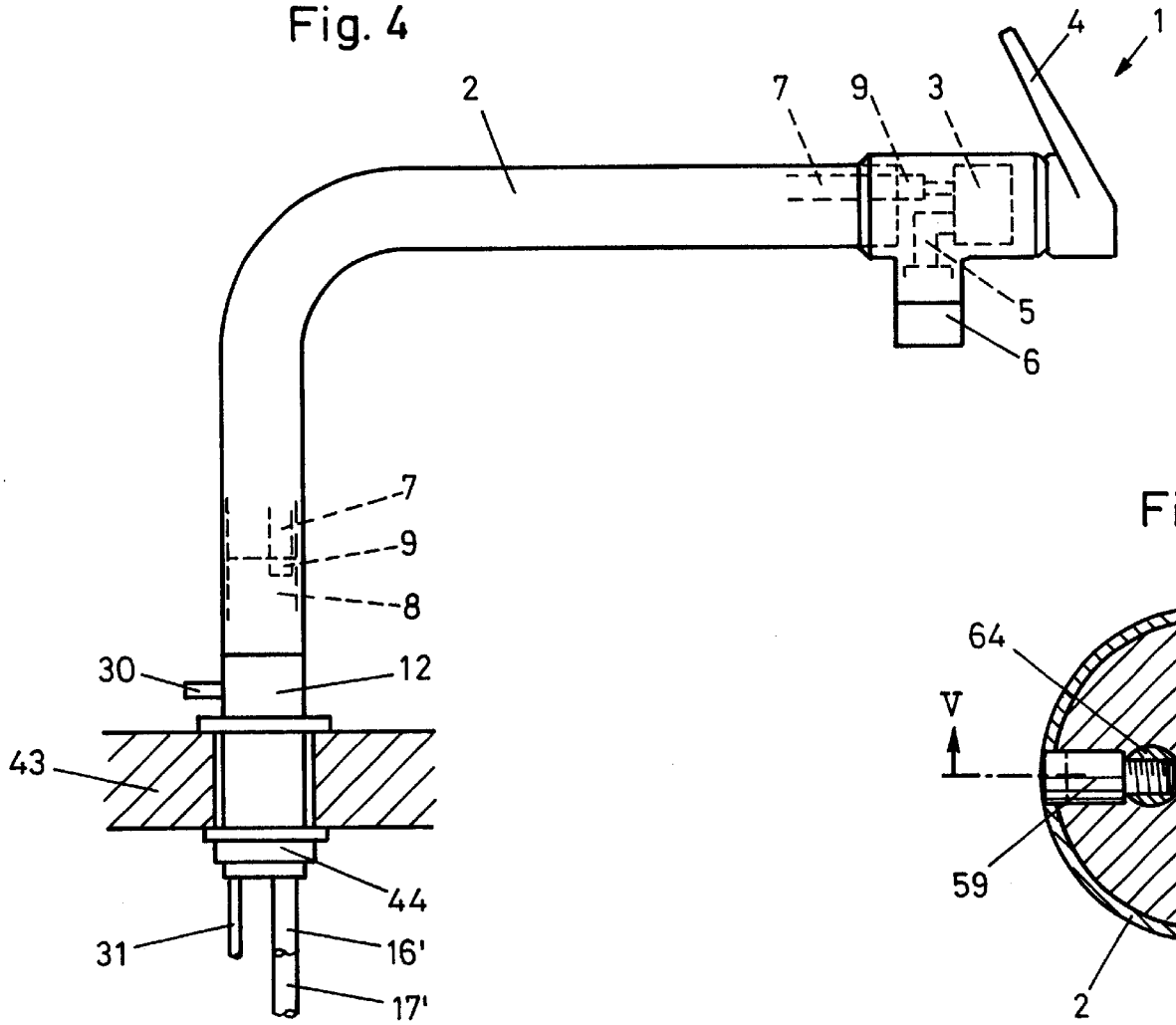
FIGS. 4 to 6 show corresponding illustrations of a second embodiment.
Figure 6:
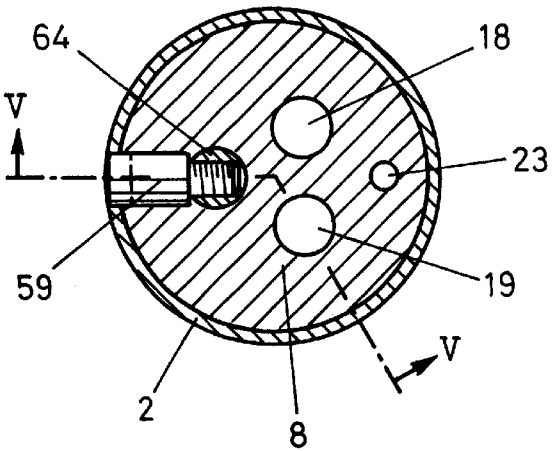
Figure 5:
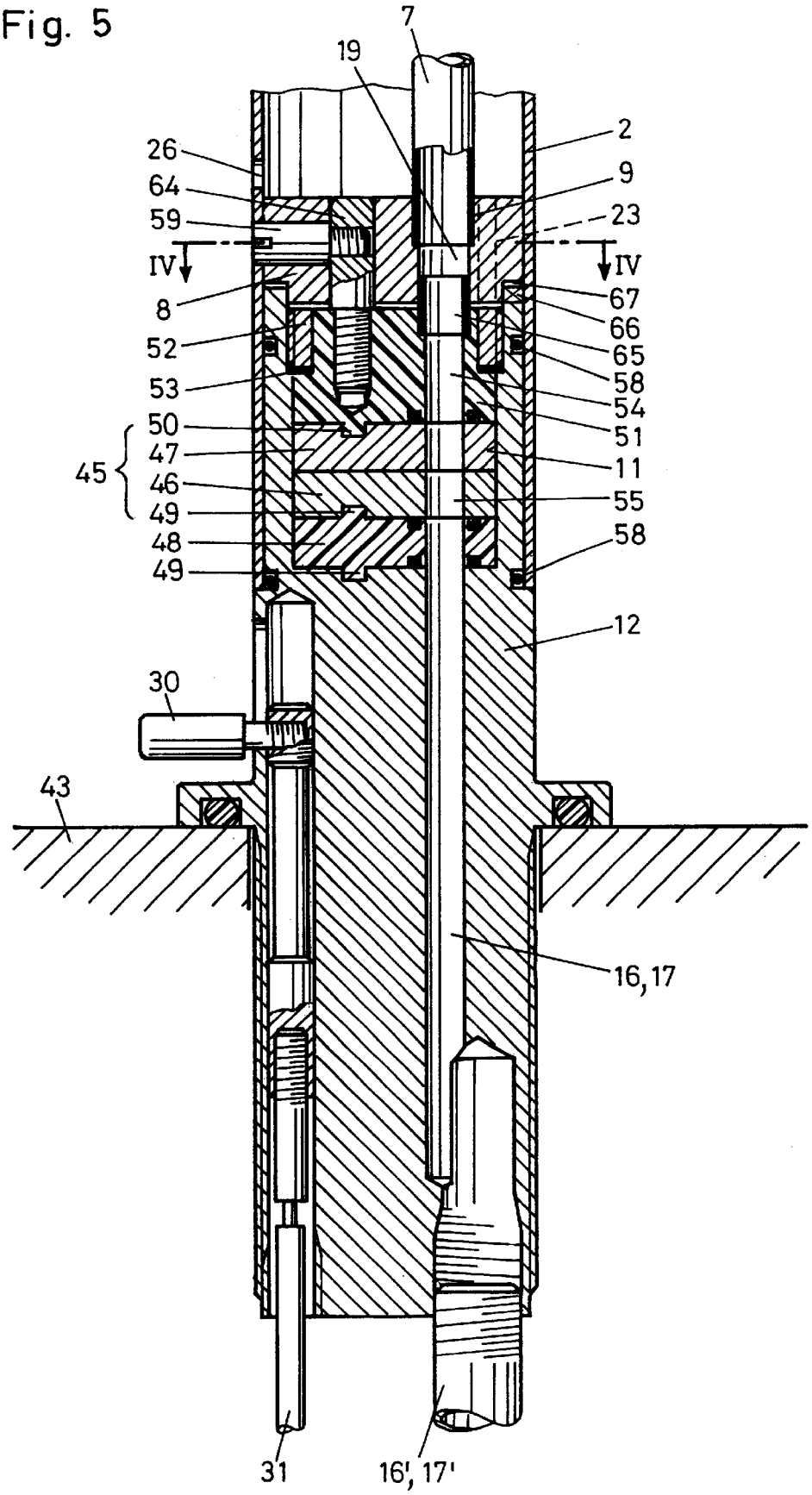

In the second embodiment example according to FIGS. 4 to 6, analogous parts have been given the same reference numbers, so that a detailed description of these parts is superfluous. The second embodiment example differs from the first mainly through a different hydraulic rotating connection.

The base part 12 is tightly screwed into the working surface 43 using the conventional clamping means 44. In the sack-like boring 11 is a ceramic disc packet 45. It consists of an immobile disc 46 and a rotating disc 47. A floor plate 48 has one cam 49 each at the bottom and at the top which prevents distorsion with respect to the base part 12 and the immobile disc 46. By means of a cam 50, the rotating disc 47 is tightly connected to the portable part 51, so as not to rotate. Using a circular screw 52 with sliding disc 53, the entire packet 48,46, 47 and 51 is lightly pressed and axially fixed, such that distorsion is possible between the immobile disc 46 and the rotating disc 47, while, at the same time, however, the sealing function of both discs is guaranteed. Both discs 46, 47 each have a passage for cold water and a passage 55 for warm water. The geometry of these passages is formed in such a way (for example, by means of arch-shaped long holes), that, in every rotation position of the pivoting outlet 2, these passage remain always completely open.

In the rotating part 8, provided is a relief boring 23 and, in the pivoting outlet 2, the ventilation hole 26. Thus, it is achieved that the possibly leaking water has to exit in an upward direction and cannot impair the leading part consisting of the pivoting outlet 2 with the base part 12. Two sealing and braking O-rings 58 guarantee the tight seal. They, together with the fictional resistance of both discs 46, 47, result in the required torque resistance.

By loosening the screw 59, the pivoting outlet 2 including the rotating part 8 can be diverted upward. A stay bolt 64 is screwed into the portable part 51. The tightening screw 59 is screwed cross-wise into this stay bolt 64 and serves to axially fixate the pivoting outlet 2. Two pipe pieces 65 are also tightly inserted into the rotating part 8. They, together with the stay bolt 64, serve to provide a rotationally secure connection between the rotating part 8 and the portable part 1. One cam 66 at the base part 12 serves to limit the pivoting angle. It grips into a corresponding groove 67 of the rotating part 8.

The cold and warm water supply 16', 17' can consist, for example, of copper pipes or flexible hoses. These are tightly connected to the base part 12.

By means of special arrangement of both of the passages 55 in the ceramic disc packet 45, it would also be possible to place a third boring centrally. This variant, then, has three copper pipes in the pivoting outlet, as is necessary, for example, for pressure-free boilers.

By means of the special arrangement of the rotation connection, the pivoting mechanism is not strained with an axial force and no pivoting angle-dependent torque is formed. Through the relief boring 23 in the rotating 8 it is achieved that, between the pivoting part 8 and the tight base part, no pressure can build up, and that, in the case of leakage from an O-ring seal, no leaking water can exist downward, where it could cause more damage before being discovered. The leaking water would, in such a case, climb up through the relief boring 23 and exist visibly through the ventilation boring 26 onto the working surface 43. A further advantage exists in that, by loosening one (or two) of the screws 27, the entire outlet 2 including the mixer valve 1 can be dismantled and replaced with a different outlet 2 which, for example, has a different discharge or a different outlet height or a different color or a different pivoting angle.

In the embodiment according to FIGS. 4 to 6, through the special arrangement of the disc rotation connection, the pivoting mechanism is strained by only a very slight axial force which results from the product of the surface of both of the borings 54 in the portable part 51 and the water pressure.

Figure 2:
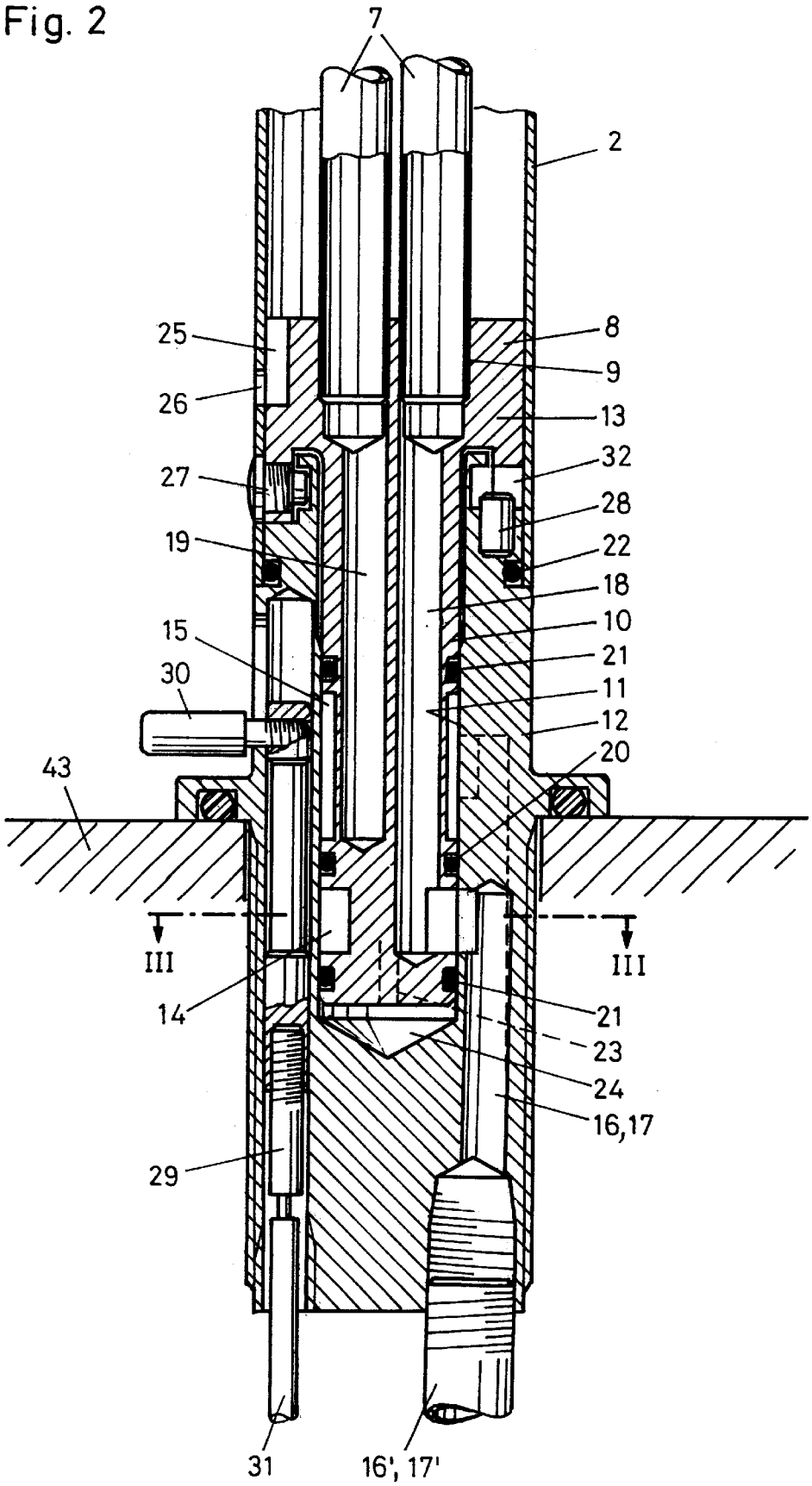
FIG. 2 shows a longitudinal cross-section of the rotating connection along line II—II in FIG. 3.
Figure 7:
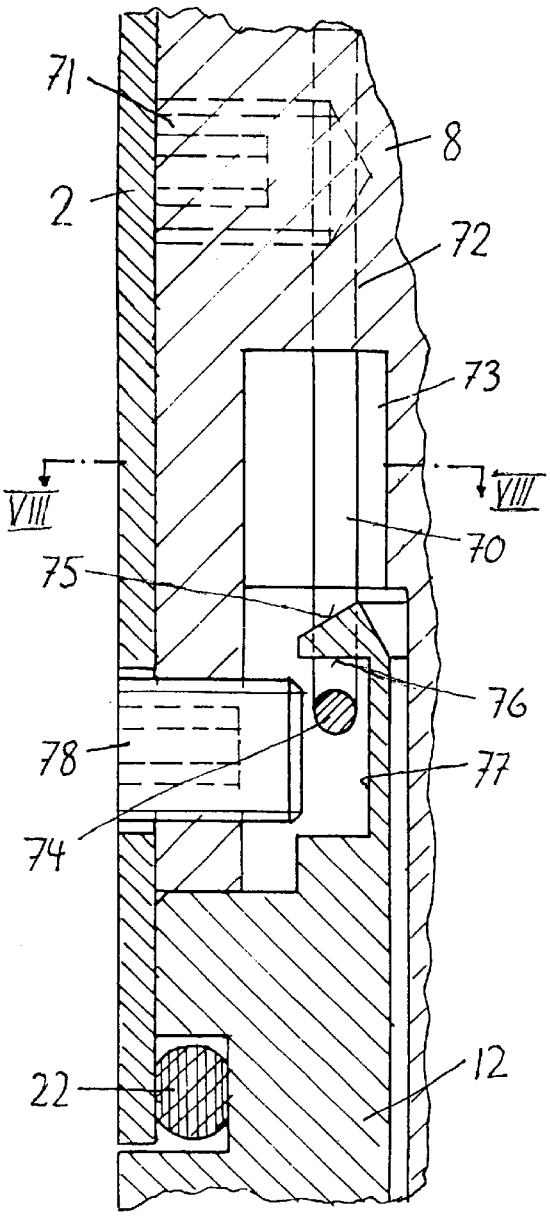
FIGS. 7 and 8 show a cross-section of a variant of the embodiment according to FIGS. 1 to 3.
Figure 8:
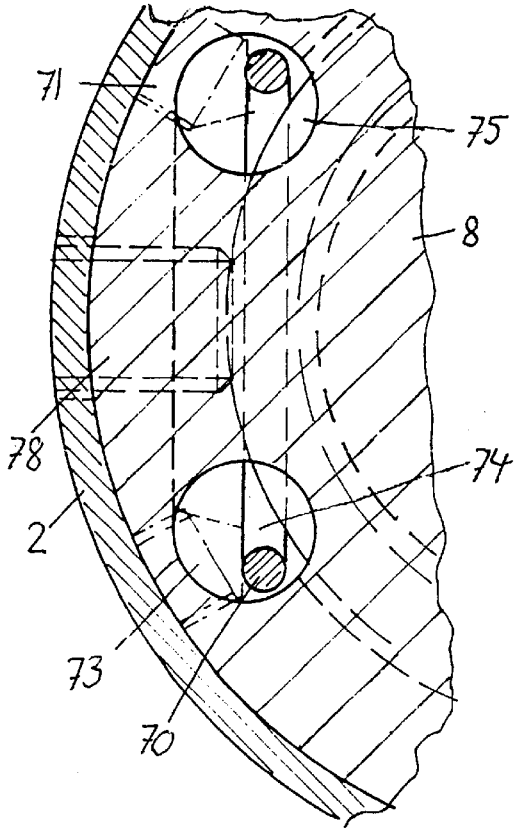

In FIGS. 7 and 8, a cross-section of one variant of the embodiment according to FIGS. 1–3 is illustrated. In this variant, collaborating snap elements are arranged on the base part 12 instead of the screw 27 (FIG. 2) between the rotating part 8 and the base part 12 in order to axially secure the pivoting outlet 2. The embodiment with the screw 27 according to FIG. 2 has the disadvantage that any person, thus also any unauthorized person, can loosen and remove the outlet 2. Since the check valves are located only at the end of the outlet 2, the outlet is always under pressure. An unauthorized or unintentional removal of the outlet would thus cause water to run off in an uncontrolled manner. The variant according to FIGS. 7 and 8 prevent this with much security.

In the rotating part 8, a U-shaped bow 70 made of elastic steel is inserted from the bottom. The fixation occurs via two screws 71 which tightly clamp the bow in two borings 72. The screws 71 are only located in the rotating part 8 and are not visible after the installation of the outlet 2. Two widened borings 73 allow the bow the elasticity necessary for installation and dismantling of the outlet. In the installation of the complete outlet 2 with the rotating part 8, the horizontal arm 74 of the bow 70 slides over the slanting surface 75 and then snaps into the illustrated position behind a shoulder 76 of a circumferential groove 77 of the base part 2. A dismantling of the outlet is not possible now without the use of special tools. For double safety, one more screw 78 made of plastic is screwed into the rotating part 8 which screw holds securely in place the horizontal arm 74 of the bow 70. At the same time, the screw 78 serves as a rotation security between the outlet 2 and the rotating part 8. The screw 78 also has the purpose to prevent dirt and soap from entering the rotating mechanism.

The intentional dismantling of the outlet by an expert occurs as follows: At first, the screw 78 is removed. Then, the horizontal arm 74 of the bow 70 is pulled outward through the threaded hold with the aid of a hook-shaped tool and the outlet pulled upward at the same time. Due to the groove 77 that runs circumferentially, the outlet 2 remains, while installed, in a pivoting state with respect to the base part 12.

Instead of the bow 70, also other snapping elements can be employed for snapping into the circumferential groove 77. The elastic snapping element can also be arranged at the base part 12 and the non-elastic corresponding snapping element can be provided at the rotating part 8.

What is claimed is:

1. Outlet armature, comprising a base part (12), in which a pivoting outlet (2) is mounted in a pivoting manner, in which a mixer valve (1) with one connection (9) each for cold and warm water is integrated, characterized in that a rotating part (8) is inserted into the base part (12) with one first canal (18, 19) each for cold and warm water, that lines (7) connect the first canals (18, 19) with the connections (9), that supply lines (16', 17') for cold and warm water are connected to second canals (16, 17) in the base part (12), the supply lines (16', 17') connected to the second canals (16, 17) in direction of an axis of the second canals (16, 17), and that the first and second canals (16–19) are connected hydraulically via a separate pivoting connection each.

2. Outlet armature, according to claim 1, wherein the pivoting connection contains two axially shifted grooves (14, 15) for cold and warm water, into which the first and second canals (16–19) lead.

3. Outlet armature, according to claim 2, wherein the rotating part (8) is at least partially inserted into an axial sack-like boring (11) of the base part (12) and contains a relief boring (23) which communicates with a ventilation boring (26) of the outlet (2).

4. Outlet armature, according to claim 1, wherein the pivoting connection contains ceramic disc packet (45) with a first disc (47) that is connected rotationally tight to the rotating part and a second disc (46) that is connected rotationally tight to the base part (12) which, at every rotation position of the pivoting outlet (2), exhibits a complete passage cross-section for not only the warm water but also the cold water.

5. Outlet armature, according to claim 4, wherein the rotationally tight connection between the first disc (47) and the rotating part (8) contains a portable part (51) which is held in the base part (12) in a rotationally tight but axially shifting manner, and wherein an axle-parallel stay bolt (64) is screwed into the portable part (51), into which a screw (59) is screwed cross-wise to the pivoting axle which axially secures the pivoting outlet (2) and the rotating part (8) to the base part (12).

6. Outlet armature, according to claim 4, wherein the ceramic disc packet (45) has three passages which in each pivoting position of the pivoting outlet (2) exhibit complete passage.

7. Outlet armature, according to claim 6, wherein a first of the three passages is centrally arranged and the remaining passages are formed in a bow-like manner with distance from the center of the first of the three passages.

8. Outlet armature, according to claim 6, wherein the lines (7) are connected to the first canals (18, 19) in direction of an axis of the first canals (18, 19).

9. Outlet armature, according to claim 4, wherein the pivoting of the rotating part (8) with respect to the base part (12) is limited and the rotating part (8) is held in the base part (12) so as not to shift axially.

10. Outlet armature, according to claim 1, wherein the base part (12) and the rotating part (8) has collaborating snap elements (70, 76) which snap into place in the axial installation of the rotating part (8) onto the base part (12) and allow for the rotation of the rotating part with respect to the base part.

11. Outlet armature, according to claim 10, wherein the snapping elements (70, 76) contain an elastic bow (70) which snaps into place behind a shoulder (76).

12. Outlet armature, according to claim 10, wherein the pivoting outlet contains a curved pipe (2) which rigidly connects the rotating part (8) with the mixer valve (1) and, in turn, contains the lines (7).

13. Outlet armature, according to claim 1, wherein the rotating part (8) is at least partially inserted into an axial sack-like boring (11) of the base part (12) and contains a relief boring (23) which communicates with a ventilation boring (26) of the outlet (2).

14. Outlet armature, according to claim 1, wherein the pivoting of the rotating part (8) with respect to the base part (12) is limited and the rotating part (8) is held in the base part (12) so as not to shift axially.

15. Outlet armature, according to claim 1, wherein the pivoting outlet contains a curved pipe (2) which rigidly connects the rotating part (8) with the mixer valve (1) and, in turn, contains the lines (7).

16. Outlet armature, comprising a base part (12), in which a pivoting outlet (2) is mounted in a pivoting manner, in which a mixer valve (1) with one connection (9) each for cold and warm water is integrated, characterized in that a rotating part (8) is inserted into the base part (12) with one first canal (18, 19) each for cold and warm water, that the first canals (18, 19) are connected via lines (7) with the connections (9), that supply lines (16', 17') for cold and warm water are connected to second canals (16, 17) in the base part (12), that the first and second canals (16–19) are connected hydraulically via a separate pivoting connection each and that the base part (12) and the rotating part (8) has collaborating snap elements (70, 76) which snap into place in the axial installation of the rotating part (8) onto the base part (12) and allow for the rotation of the rotating part with respect to the base part.

17. Outlet armature, comprising a base part (12), in which a pivoting outlet (2) is mounted in a pivoting manner, in which a mixer valve (1) with one connection (9) each for cold and warm water is integrated, characterized in that a rotating part (8) is inserted into the base part (12) with one first canal (18, 19) each for cold and warm water, that the first canals (18, 19) are connected via lines (7) with the connections (9), that supply lines (16', 17') for cold and warm water are connected to second canals (16, 17) in the base part (12), that the first and second canals (16–19) are connected hydraulically via a separate pivoting connection each and that the rotating part (8) is at least partially inserted into a axial sack-like boring (11) of the base part (12) and contains a relief boring (23) which communicates with a ventilation boring (26) of the outlet (2).

* * * * *

UNITED STATES PATENT AND TRADEMARK OFFICE

CERTIFICATE OF CORRECTION

PATENT NO. : 6,321,788 B1
DATED : November 27, 2001
INVENTOR(S) : Werner Egli

It is certified that error appears in the above-identified patent and that said Letters Patent is hereby corrected as shown below:

Title page,
Item [73], Assignee, change "Armaturefabrik" to -- "Armaturenfabrik" --

Signed and Sealed this

Twenty-third Day of April, 2002

*Attest:*

*Attesting Officer*

JAMES E. ROGAN
*Director of the United States Patent and Trademark Office*